US009022382B2

(12) United States Patent
Takai et al.

(10) Patent No.: US 9,022,382 B2
(45) Date of Patent: May 5, 2015

(54) SHEET FEED DEVICE AND IMAGE FORMING APPARATUS INCLUDING THE SAME

(71) Applicant: KYOCERA Document Solutions Inc., Osaka (JP)

(72) Inventors: Hiroaki Takai, Osaka (JP); Yoshiaki Tashiro, Osaka (JP); Toshio Hori, Osaka (JP); Yoshio Sugishima, Osaka (JP); Hideaki Doyo, Osaka (JP); Noriko Masuta, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/334,436

(22) Filed: Jul. 17, 2014

(65) Prior Publication Data

US 2015/0028536 A1 Jan. 29, 2015

(30) Foreign Application Priority Data

Jul. 25, 2013 (JP) ..... 2013-154301

(51) Int. Cl.

| | |
|---|---|
| ***B65H 3/52*** | (2006.01) |
| ***B65H 3/06*** | (2006.01) |
| ***B65H 1/26*** | (2006.01) |
| *B65H 1/08* | (2006.01) |

(52) U.S. Cl.

CPC ..... *B65H 3/52* (2013.01); *B65H 3/0684* (2013.01); *B65H 3/5261* (2013.01); *B65H 3/5215* (2013.01); *B65H 1/266* (2013.01); *B65H 1/08* (2013.01); *B65H 2404/144* (2013.01); *B65H 2405/121* (2013.01); *B65H 2405/31* (2013.01); *B65H 2404/1441* (2013.01)

(58) Field of Classification Search

CPC ..... B65H 3/46; B65H 3/52; B65H 3/5207; B65H 3/5215; B65H 3/5246; B65H 3/5153; B65H 3/5261; B65H 2404/14; B65H 2404/144; B65H 2404/1441; B65H 2404/1442; B65H 2404/142; B65H 2404/1421; B65H 2404/14211; B65H 2404/152; B65H 2404/1521; B65H 2405/12; B65H 2405/121; B65H 2405/31; B65H 2405/32; B65H 2405/313; B65H 2405/325; B65H 1/00; B65H 1/08; B65H 1/266

See application file for complete search history.

(56) References Cited

U.S. PATENT DOCUMENTS 4,572,498 A * 2/1986 Shiozawa ..... 271/34
5,451,043 A * 9/1995 Arai ..... 271/122

(Continued)

FOREIGN PATENT DOCUMENTS

JP 2002-205832 A 7/2002

*Primary Examiner* — Ernesto Suarez
(74) *Attorney, Agent, or Firm* — Stein IP, LLC

(57) ABSTRACT

A sheet feed device includes a feed unit and a sheet loading cassette. The feed unit includes a separation conveyance portion that is composed of a feed member and a separation member, a separation holder that supports the separation member and is swingable, and a pressing member that presses the separation holder. The sheet loading cassette includes a grip portion, a pressure release member that, in conjunction with an operation of drawing out the sheet loading cassette, comes into contact with the pressing member, an operation lever that is provided at the grip portion. In a state where the sheet loading cassette is inserted in the apparatus main body, the operation lever is gripped together with the grip portion, and thus the pressure release member slides to come into contact with the pressing member, so that the pressing member is released from the separation holder.

8 Claims, 7 Drawing Sheets

(56) References Cited

U.S. PATENT DOCUMENTS 6,695,303 B2 * 2/2004 Okada et al. ..... 271/9.12
8,113,505 B2 * 2/2012 Lee ..... 271/167
8,132,809 B2 * 3/2012 Shiraishi et al. ..... 271/162
8,428,506 B2 * 4/2013 Miki ..... 399/393
8,523,173 B2 * 9/2013 Hayayumi ..... 271/117
8,695,965 B2 * 4/2014 Shin et al. ..... 271/121

* cited by examiner

SHEET FEED DEVICE AND IMAGE FORMING APPARATUS INCLUDING THE SAME

INCORPORATION BY REFERENCE

This application is based on and claims the benefit of priority from Japanese Patent Application No. 2013-154301, filed on Jul. 25, 2013, the contents of which are hereby incorporated by reference.

BACKGROUND OF THE INVENTION

The present disclosure relates to a sheet feed device in which a recording medium housing cassette for housing a sheet-shaped recording medium is drawably mounted and that is used in a copy machine, a printer, a facsimile, or the like, and relates particularly to a configuration that prevents a sheet from being damaged when the recording medium housing cassette is drawn out or a roller from being deformed after storage for a long time.

Conventionally, an image forming apparatus such as a copy machine, a printer, or a facsimile has a configuration in which, at a bottom portion of a main body of the apparatus, a paper feed cassette for housing a plurality of paper sheets (recording media) is provided so as to be drawable from the main body of the image forming apparatus. By a feed-out unit composed of a pick-up roller and so on and a separation conveyance unit composed of a paper feed roller and so on, which are provided above the paper feed cassette, the paper sheets housed in the paper feed cassette are fed out one by one in order, and by a conveyance roller, each of the paper sheets thus fed out is conveyed to an image forming portion and a fixing portion so that an image is formed thereon.

The configuration described above has been disadvantageous in that, when, in a state where a paper sheet is nipped by the separation conveyance unit, the paper feed cassette is drawn out from the main body of the image forming apparatus, there is a possibility that the paper sheet is damaged such as being torn or flawed. There has thus been proposed a method for preventing a paper sheet from being torn or flawed when a paper feed cassette is drawn out, and there is known, for example, a paper feed device in which, by a nip release member that moves, in coordination with an operation of drawing out/inserting a paper feed tray, in a direction orthogonal to a direction in which the paper feed tray is drawn out/inserted, a feed-out roller is separated from a paper sheet, and a pressure contact state between rollers constituting a dispensing conveyance roller pair is released.

In this configuration, in a state where the paper feed tray has been inserted, the rollers constituting the dispensing conveyance roller pair are in a pressure contact state with each other, and in a state where the paper feed tray has been drawn out, the pressure contact state between the rollers constituting the roller pair is released. Because of this, there occurs a time lag, albeit of short duration, between a time when drawing out of the paper feed tray is started and a time when the pressure contact state between the rollers constituting the dispensing conveyance roller pair is released. Hence, immediately after drawing out of the paper feed tray is started, a paper sheet is pulled in a state of being nipped between the rollers constituting the dispensing conveyance roller pair, which has rendered it impossible to completely prevent damage to paper sheets.

Furthermore, in a case where the image forming apparatus is kept in storage for along time in a state where the paper feed tray is inserted therein, a pressure contact state between the rollers constituting the dispensing conveyance roller pair is kept for a long time, which also has led to a problem that a feed roller (feed member) or a retard roller (separation member), which constitute the dispensing conveyance roller pair, is deformed due to a contact pressure therebetween.

SUMMARY OF THE INVENTION

A sheet feed device according to one aspect of the present disclosure includes a feed unit that is provided in an apparatus main body and a sheet loading cassette that is mounted so as to be insertable in or drawable from the apparatus main body. The feed unit includes a feed-out member that is brought into pressure contact with an upper surface of a sheet loaded in the sheet loading cassette and causes the sheet to move in a predetermined direction so that the sheet is fed out one after another, a separation conveyance portion that is composed of a feed member that is disposed on a downstream side of the feed-out member in a sheet conveyance direction and a separation member that is disposed to be opposed to the feed member, and conveys a sheet fed out by the feed-out member one by one, a separation holder that supports the separation member and is swingable in such a direction that the separation member comes into contact with or is separated from the feed member, and a pressing member that presses the separation holder in such a direction that the separation member comes into contact with the feed member. The sheet loading cassette includes a grip portion that is used to perform an operation of inserting or drawing out the sheet loading cassette, a pressure release member that, in conjunction with the operation of drawing out the sheet loading cassette, comes into contact with the pressing member and thus releases the pressing member from the separation holder, an operation lever that is protrudably and retractably provided at the grip portion, and a first biasing member that biases the operation lever in a protruding direction of the operation lever. In conjunction with an operation in which the operation lever protrudes or retracts, the pressure release member is slidable with respect to the sheet loading cassette. In a state where the sheet loading cassette is inserted in the apparatus main body, the operation lever is gripped together with the grip portion, and thus the pressure release member slides to come into contact with the pressing member, so that the pressing member is released from the separation holder.

Still other objects of the present disclosure and specific advantages provided by the present disclosure will be made further apparent from the following description of an embodiment.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
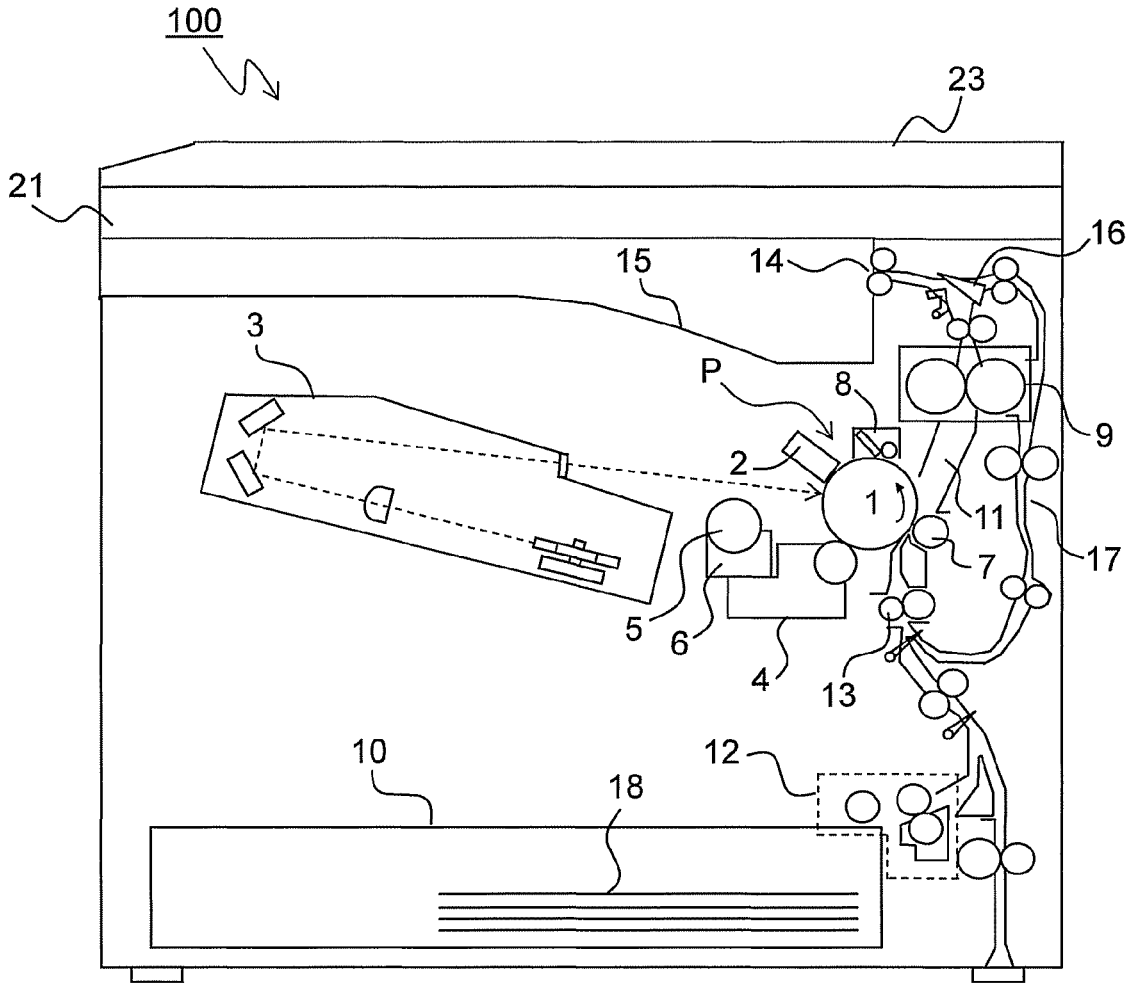
FIG. 1 is a schematic sectional view of an image forming apparatus 100 including a sheet feed device according to one embodiment of the present disclosure.
Figure 2:
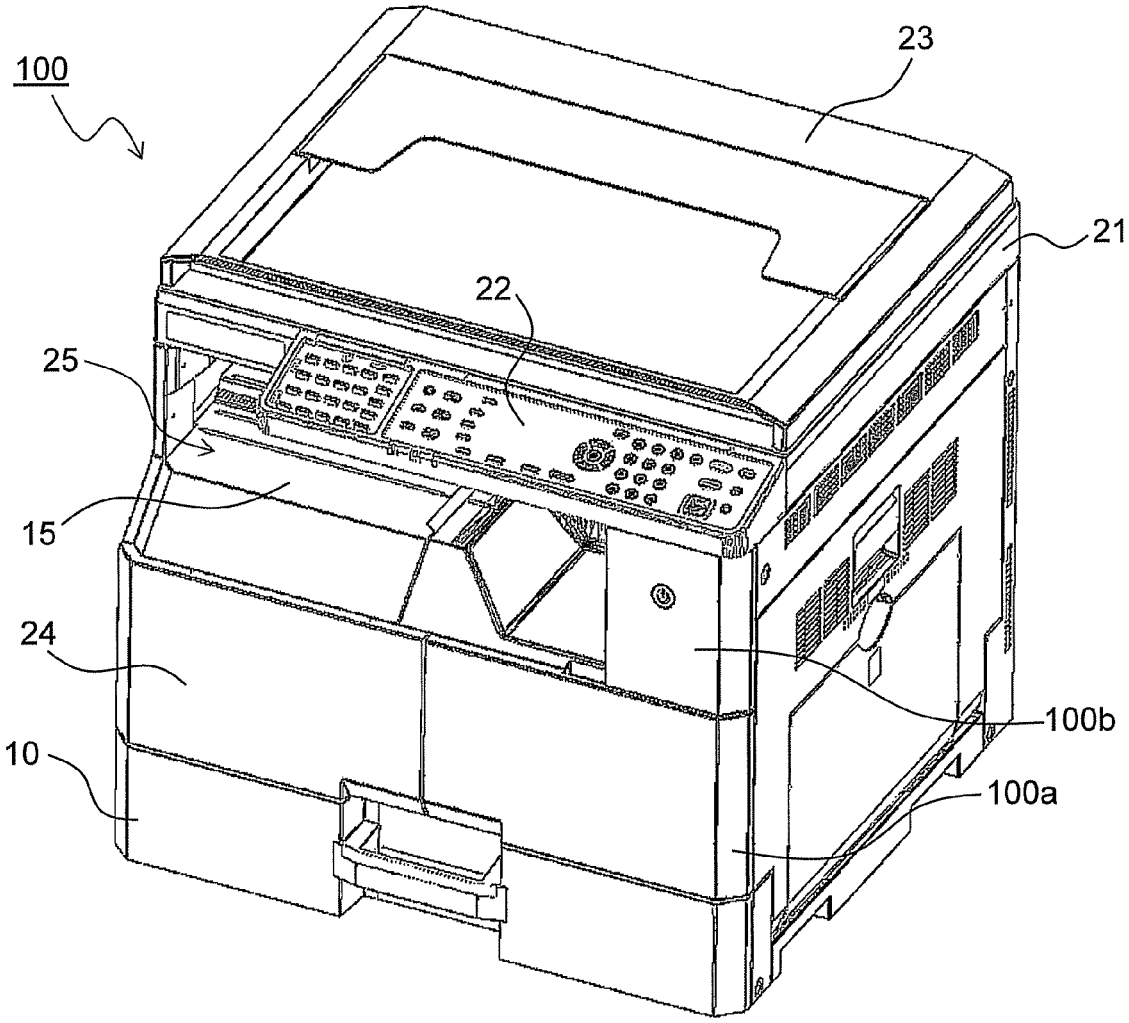
FIG. 2 is an outer appearance perspective view of the image forming apparatus 100 as seen from a forward direction in FIG. 1.

With reference to the appended drawings, the following describes an embodiment of the present disclosure. FIG. 1 is a schematic sectional view of an image forming apparatus 100 including a sheet feed device according to one embodiment of the present disclosure, and FIG. 2 is an outer appearance perspective view of the image forming apparatus 100 as seen from a front side (the forward direction in FIG. 1). Herein, as the image forming apparatus 100, a monochrome multi-functional peripheral is described. In a main body of the image forming apparatus 100, there is provided an image forming portion P that forms a monochrome image by performing processes of charging, exposure, development, and transfer.

In the image forming portion P, along a rotation direction (a counterclockwise direction in FIG. 1) of a photosensitive drum 1, a charging portion 2, an exposure unit 3, a developing device 4, a transfer roller 7, a cleaning device 8, and a static eliminator (not shown) are provided. In the image forming portion P, while the photosensitive drum 1 is made to rotate in the counterclockwise direction in FIG. 1, an image forming process with respect to the photosensitive drum 1 is carried out.

The photosensitive drum 1 is formed by, for example, applying a photosensitive layer onto an aluminum drum, and a surface thereof is charged by the charging portion 2. On the surface of the photosensitive drum 1 in an area where a laser beam from the after-mentioned exposure unit 3 is received, an electrostatic latent image having attenuated charge is formed. As the above-described photosensitive layer, though there is no particular limitation, preferably used is, for example, a layer of amorphous silicon (a-Si) having excellent durability, an organic photosensitive layer (OPC) that is suppressed in terms of ozone generation at the time of being charged and allows high-resolution images to be formed, or the like.

The charging portion 2 uniformly charges the surface of the photosensitive drum 1. For example, as the charging portion 2, there is used a corona discharging device in which a thin wire or the like is used as an electrode, and applying a high voltage to the electrode causes the corona discharging device to perform discharging. Instead of the corona discharging device, there may be used a contact-type charging device that applies a voltage while a charging member thereof represented by a charging roller being kept in contact with a surface of a photosensitive member. Based on original document image data read at an image reading portion 21, the exposure unit 3 irradiates the photosensitive drum 1 with a light beam (for example, a laser beam) to form an electrostatic latent image on the surface of the photosensitive drum 1.

The developing device 4 makes toner adhere to an electrostatic latent image on the photosensitive drum 1 to form a toner image thereon. Toner is supplied to the developing device 4 from a toner container 5 via an intermediate hopper 6. Herein, a one-component developer (hereinafter, may be referred to simply as toner) made only of a toner component having a magnetic property is stored in the developing device 4.

The transfer roller 7 transfers a toner image formed on the surface of the photosensitive drum 1, without making any change thereto, onto a paper sheet conveyed along a paper sheet conveyance path 11. The cleaning device 8 includes a cleaning roller, a cleaning blade, and so on that are placed in line contact with the photosensitive drum 1 along a longitudinal direction thereof, and after transfer of a toner image onto a paper sheet, it removes residual toner remaining on the surface of the photosensitive drum 1.

The image reading portion 21 is composed of a scanning optical system that incorporates therein a scanner lamp that illuminates an original document at the time of copying and a mirror that changes an optical path of reflected light from an original document, a condenser lens that condenses reflected light from an original document to form an image, a CCD sensor that converts formed image light into an electric signal, and so on (none of these is shown). The image reading portion 21 reads an original document image and converts it into image data.

In a case of performing a copying operation, at the image reading portion 21, image data of an original document is read and converted into an image signal. Meanwhile, at the image forming portion P, the photosensitive drum 1 being rotating in the counterclockwise direction in FIG. 1 is uniformly charged by the charging portion 2. Then, based on the original document image data read at the image reading portion 21, the exposure unit 3 emits a laser beam (light ray) onto the photosensitive drum 1, and thus an electrostatic latent image based on that image data is formed on the surface of the photosensitive drum 1. After that, the developing device 4 makes toner adhere to the electrostatic latent image, and thus a toner image is formed.

Toward the image forming portion P where the toner image has been formed as described above, by a paper feed unit 12, a paper sheet 18 is fed out from a paper feed cassette 10 to be conveyed at a predetermined timing to the image forming portion P via the paper sheet conveyance path 11 and a registration roller pair 13. Then, in the image forming portion P, by the transfer roller 7, the toner image on the surface of the photosensitive drum 1 is transferred onto the paper sheet 18. The paper sheet 18 onto which the toner image has been transferred is separated from the photosensitive drum 1 and conveyed to a fixing portion 9 where the paper sheet 18 is then heated and pressed, and thus the toner image is fixed onto the paper sheet 18.

A conveyance direction of the paper sheet P after having passed through the fixing portion 9 is controlled by a branching portion 16 branching off in a plurality of directions. In a case where it is intended to form an image only on one side of the paper sheet 18, the paper sheet 18 is directly ejected onto an ejection tray 15 by an ejection roller pair 14.

On the other hand, in a case where it is intended to form images on both sides of the paper sheet 18, the paper sheet 18 after having passed through the fixing portion 9 is once conveyed in a direction of the ejection roller pair 14, and after a rear end of the paper sheet 18 has passed through the branching portion 16, the ejection roller pair 14 is made to rotate inversely, while the conveyance direction is switched at the branching portion 16, so that the paper sheet 18 is led from the rear end thereof into a reverse conveyance path 17 along which the paper sheet 18 is conveyed, with one side thereof on which the image has been formed turned upside down, again to the registration roller pair 13. Then, by the transfer roller 7, an image to be transferred next, which has been formed on the photosensitive drum 1, is transferred onto the other side of the paper sheet 18, on which no image has been formed. Thereafter, the paper sheet 18 is conveyed to the fixing portion 9, where the toner image is fixed, and then is ejected onto the ejection tray 15.

As shown in FIG. 2, on an upper surface of the image reading portion 21, there are provided an original document placing table (not shown) to which a transparent glass plate (contact glass) is mounted and an operation panel 22 that is disposed so as to protrude to a front side of the main body of the image forming apparatus 100. Furthermore, on the upper surface of the image reading portion 21, a platen (original document presser) 23 that holds under pressure an original document placed on the original document placing table is openably and closably supported.

Figure 3:
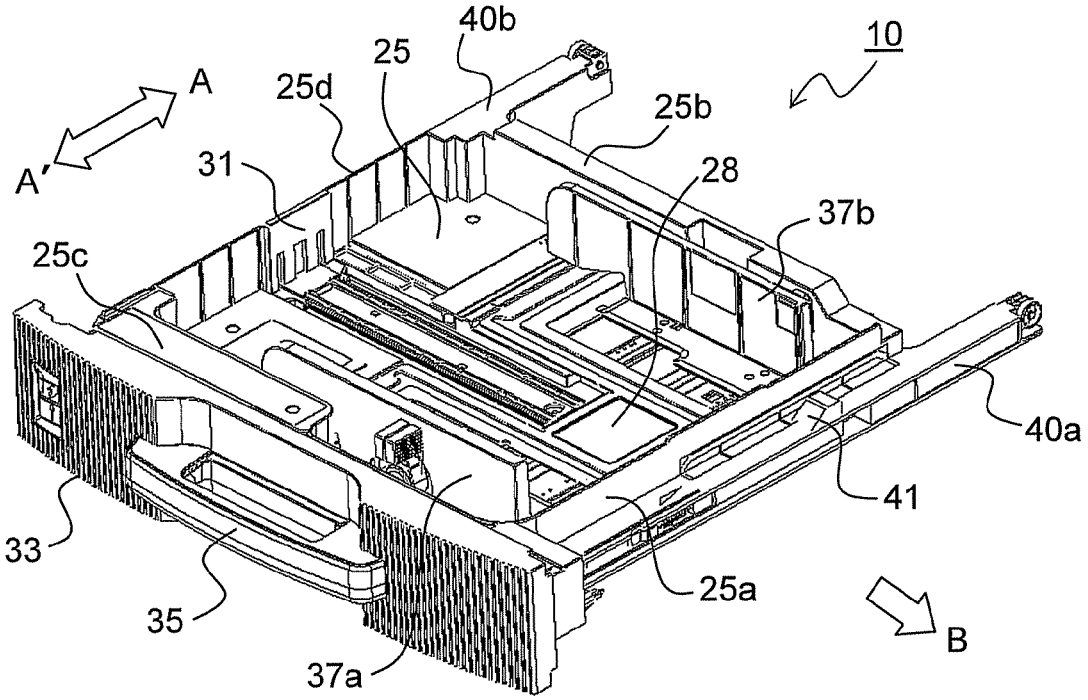
FIG. 3 is an outer appearance perspective view of a paper feed cassette 10 mounted in the image forming apparatus 100.
Figure 4:
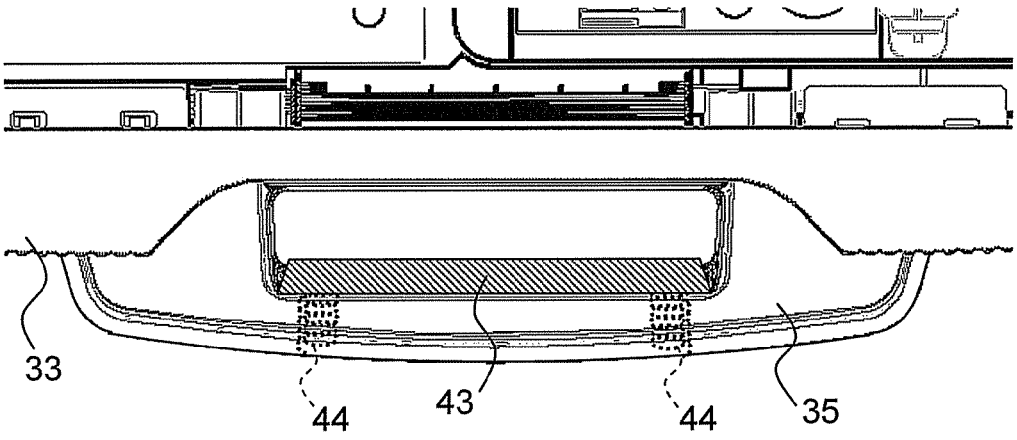
FIG. 4 is a partial plan view of a grip portion 35 of the paper feed cassette 10.

Furthermore, on a front side of a housing 100*a*, a front cover 24 is openably and closably provided. With the front cover 24 opened, maintenance and replacement of various members in the housing 100*a* are performed FIG. 3 is an outer appearance perspective view of the paper feed cassette 10 that is mounted in the image forming apparatus 100, and FIG. 4 is a partial plan view of a grip portion 35 of the paper feed cassette 10. In FIG. 3, a left forward side corresponds to the front side (a forward side in FIG. 2) of the image forming apparatus 100. Furthermore, in FIG. 3, with respect to the housing 100*a*, an insertion direction of the paper feed cassette 10 is indicated by an arrow A, a drawing-out direction thereof by an arrow A', and a paper feed direction of the paper feed cassette 10 by an arrow B.

As shown in FIG. 3, at peripheral edge portions in all directions of a cassette base 25 constituting a bottom surface of the paper feed cassette 10, wall portions 25*a* to 25*d* are provided in a standing manner. A cassette cover 33 is mounted to the wall portion 25*c* on an upstream side in the insertion direction of the paper feed cassette 10. The cassette cover 33 is exposed at its surface side (a left side in FIG. 3) to the outside and thus constitutes a part of an exterior surface of the main body of the image forming apparatus 100 (see FIG. 2). Furthermore, at a center portion of the cassette cover 33, there is provided the grip portion 35 to be gripped when the paper feed cassette 10 is inserted/drawn out.

A paper sheet stacking plate 28 on which the paper sheet 18 (see FIG. 1) is stacked is provided so as to be movable, at its downstream side in the paper feed direction (an arrow B direction in FIG. 3), up and down with respect to the cassette base 25 about a swing axis as a fulcrum, which extends laterally (to both ends in an arrow A-A' direction). Furthermore, on both sides of the paper sheet stacking plate 28 in its width direction, a pair of width alignment cursors 37*a* and 37*b* for performing positioning in a width direction, of the paper sheet 18 stacked on the paper sheet stacking plate 28 are provided so as to be movable back and forth in a paper sheet width direction (the arrow A-A' direction in FIG. 3) along guide grooves formed in the cassette base 25, respectively.

Furthermore, since the paper sheet 18 is fed out in the arrow B direction toward the paper sheet conveyance path 11 (see FIG. 1), a rear end cursor 31 for aligning a rear end of the paper sheet 18 is provided so as to be movable back and forth parallel to a paper sheet conveyance direction (the arrow B direction in FIG. 3) along a guide groove formed in the cassette base 25. By moving the width alignment cursors 37*a* and 37*b* and the rear end cursor 31 so as to adjust to a size of a paper sheet 18 that is stacked, the paper sheet 18 is housed at a predetermined position in the paper feed cassette 10.

On outer sides of the wall portions 25*a* and 25*d* parallel to the insertion or drawing-out direction of the paper feed cassette 10 (arrow A-A' direction), guide rails 40*a* and 40*b* are provided, respectively. On a main body side of the image forming apparatus 100 (housing 100*a* side), support portions (not shown) that slidably support the guide rails 40*a* and 40*b* are provided, and the guide rails 40*a* and 40*b* are made to slide along the support portions, respectively, so that the paper feed cassette 10 can be inserted in or drawn out from the housing 100*a*.

Figure 7:
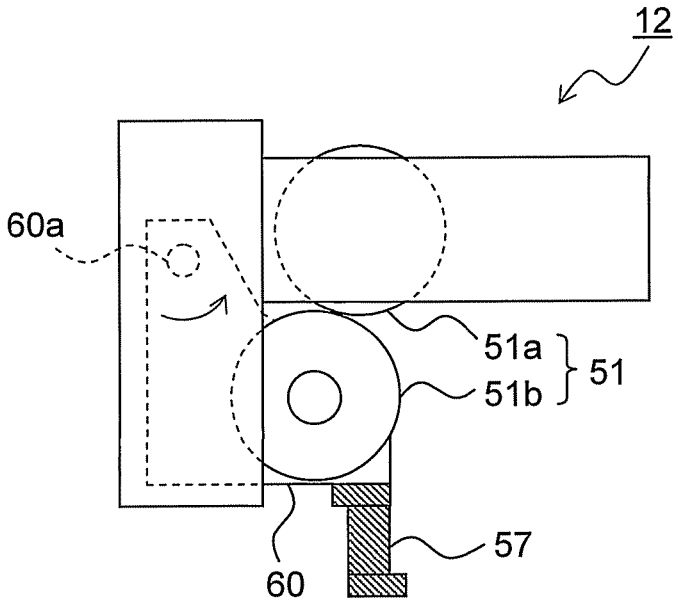
FIG. 7 is a schematic view, as seen from a left direction in FIG. 5, showing a relationship between the retard pressing lever 57 and a retard holder 60.

The guide rail 40*a* on the downstream side in the paper feed direction is provided with a lever pressure release member 41 for releasing pressing by a retard roller 51*b* against a feed roller 51*a* (see FIG. 7 for both of these rollers). The lever pressure release member 41 is linked to an operation lever 43 (see FIG. 4) provided on an inner side of the grip portion 35, and is slidable along the guide rail 40*a*. By first coil springs 44, the operation lever 43 is biased in a protruding direction (upward in FIG. 4).

Figure 5:
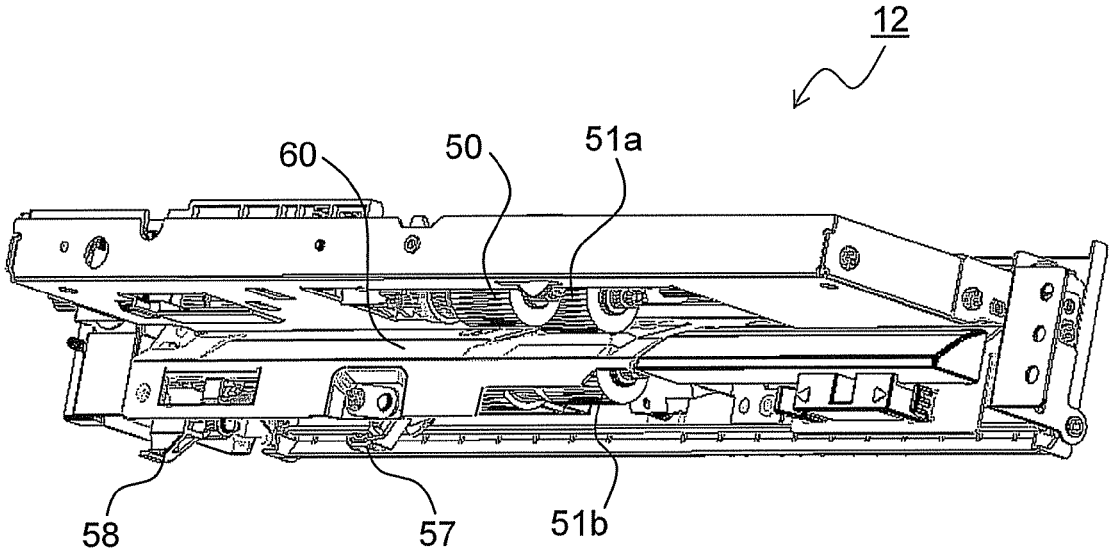
FIG. 5 is a perspective view, as seen from an upstream side in a paper feed direction (a left side in FIG. 1), of a paper feed unit 12 provided on a main body side of the image forming apparatus 100.
Figure 6:
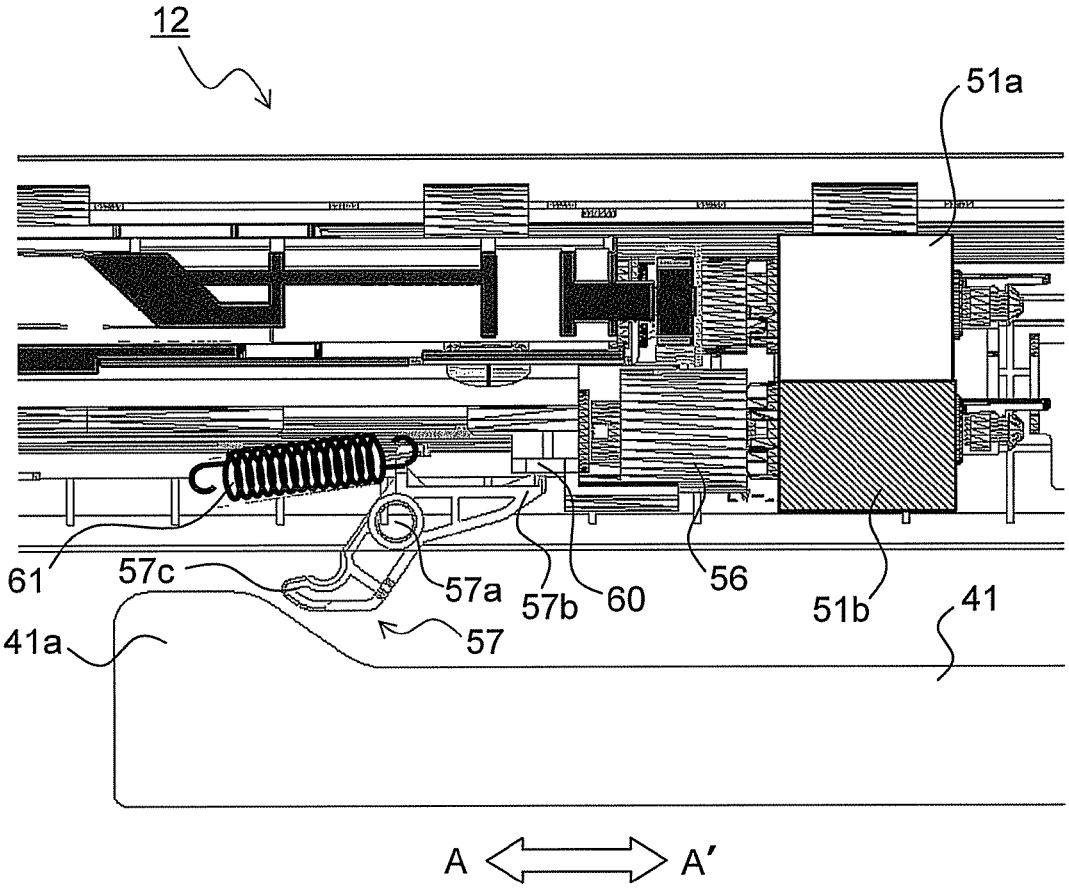
FIG. 6 is an enlarged view of a periphery of a retard pressing lever 57 constituting a pressing mechanism of a retard roller 51*b*.
Figure 8:
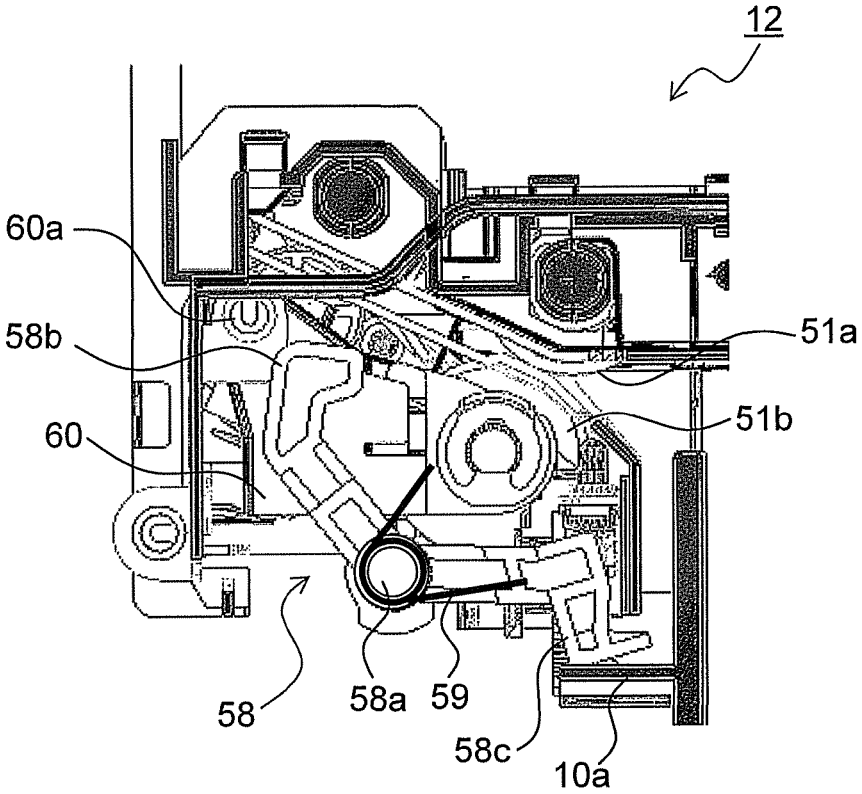
FIG. 8 is an enlarged view, as seen from the left direction in FIG. 5, of a periphery of a retard separation lever 58 for maintaining a separated state of the retard roller 51*b*, in a state where the paper feed cassette 10 is inserted in a main body of the image forming apparatus 100.

FIG. 5 is a perspective view, as seen from an upstream side in the paper feed direction (a left side in FIG. 1), of the paper feed unit 12 provided on the main body side of the image forming apparatus 100, and FIG. 6 is a partial enlarged view showing a pressing mechanism of the retard roller 51*b* in the paper feed unit 12. FIG. 7 is a schematic view, as seen from a left direction in FIG. 5, of the pressing mechanism of the retard roller 51*b*, and FIG. 8 is a partial enlarged view showing a mechanism that maintains a separated state of the retard roller 51*b* in the paper feed unit 12, in a state where the paper feed cassette 10 is inserted in the main body of the image forming apparatus 100. The paper feed unit 12 includes a pick-up roller 50, a paper feed roller pair 51, a retard pressing lever 57 that causes and releases pressing by the retard roller 51*b* against the feed roller 51*a*, and a retard separation lever 58 that maintains the retard roller 51*b* in a separated state from the feed roller 51*a*.

The pick-up roller 50 is brought into rotation by contact with an upper surface of the paper sheet 18 stacked on the paper sheet stacking plate 28 (see FIG. 3), thus feeding out the paper sheet 18 in the paper feed direction. The paper feed roller pair 51 is made up of the feed roller 51*a* and the retard roller 51*b* and conveys, one by one separately, a plurality of the paper sheets 18 fed out by the pick-up roller 50. The retard roller 51*b* has a built-in torque limiter 56 and is configured to stop when a rotational load thereof is less than a predetermined torque and to rotate following rotation of the feed roller 51*a* only when the rotational load thereof is more than the predetermined torque.

As shown in FIG. 6, the retard pressing lever 57 is swingable about a first fulcrum 57*a*, and has a pressing portion 57*b* that is in contact with a retard holder 60 supporting the retard roller 51*b* and a protruding portion 57*c* that protrudes obliquely downward from the first fulcrum 57*a* (in a direction different from a direction of the pressing portion 57*b*). By a second coil spring 61, the retard pressing lever 57 is biased in such a direction that the pressing portion 57*b* pushes up the retard holder 60 to a feed roller 51*a* side (a counterclockwise direction in FIG. 6).

As shown in FIG. 7, the retard holder 60 is supported so as to be swingable with respect to the paper feed unit 12 about a swing shaft 60*a* as a support shaft. When the pressing portion 57*b* of the retard pressing lever 57 pushes up a swing end (a right end in FIG. 7) of the retard holder 60, the retard roller 51*b* is brought into pressure contact with the feed roller 51*a*.

As shown in FIG. 8, in the paper feed unit 12, the retard separation lever 58 is disposed in a vicinity of a downstream side (back side) of a cassette mounting position with respect to the insertion direction of the paper feed cassette 10. The retard separation lever 58 is swingable about a rotary shaft (second fulcrum) 58*a* parallel to the insertion direction of the paper feed cassette 10, and has an engagement portion 58*b* to be engaged with the retard holder 60 and a protrusion 58*c* that protrudes from the second fulcrum 58*a* to a direction different from a direction of the engagement portion 58*b*. By a torsion spring 59 provided at the second fulcrum 58*a*, the retard separation lever 58 is biased in such a direction that the regard holder 60 (retard roller 51*b*) is separated from the feed roller 51*a* (a clockwise direction in FIG. 8).

Next, a description is given of a pressure contact operation in which the retard roller 51*b* is brought into pressure contact with the feed roller 51*a* and a pressure release operation in which the pressure contact between them is released. In a state where the paper feed cassette 10 is inserted in the image forming apparatus 100, as shown in FIG. 6, the lever pressure release member 41 is not in contact with the retard pressing lever 57. In this state, under a biasing force of the second coil spring 61, the pressing portion 57*b* of the retard pressing lever 57 is pushing up the retard holder 60 to the feed roller 51*a* side, and thus the retard roller 51*b* is in pressure contact with the feed roller 51*a* at a predetermined pressure. Furthermore, as shown in FIG. 8, the retard separation lever 58 is in a state where the protrusion 58*c* thereof is supported by a rib 10*a* that is formed on the guide rail 40*a* of the paper feed cassette 10 and on a side further back in the insertion direction than a convex portion 41*a* of the lever pressure release member 41, and the engagement purport 58*b* thereof is disposed at such a position as not to be engaged with the retard holder 60. At this time, the convex portion 41*a* is positioned on a side further back in the cassette insertion direction than the retard pressing lever 57 by a predetermined distance (by a stroke of the lever pressure release member 41) and is at such a position as not to come into contact with the retard pressing lever 57.

Then, the pick-up roller 50 is made to rotate in a state where an upper surface of the paper sheet 18 stacked on the paper sheet stacking plate 28 is in pressure contact with the pick-up roller 50 at a predetermined pressure, and thus feeding of the paper sheet 18 is started. In a case where a plurality of the paper sheets 18 are fed by the pick-up roller 50, by the paper feed roller pair 51, only an uppermost one of the plurality of the paper sheets 18 is separated from the others and conveyed toward the paper sheet conveyance path 11 (see FIG. 1).

Figure 9:
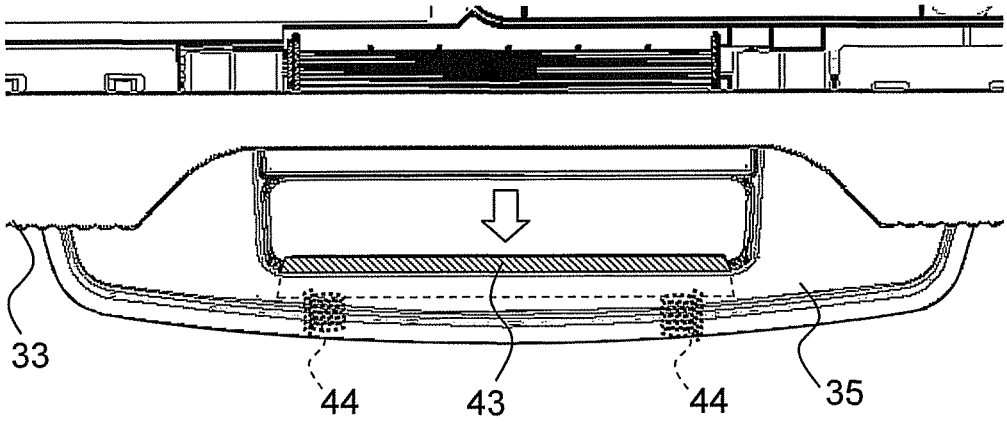
FIG. 9 is a partial plan view of the grip portion 35 showing a state where an operation lever 43 is pressed into the grip portion 35.

In a case where a bunch of the paper sheets 18 are set in the paper feed cassette 10, in order to draw out the paper sheet cassette 10, first, the grip portion 35 is gripped. At this time, together with the grip portion 35, the operation lever 43 also is gripped, so that, as shown in FIG. 9, the operation lever 43 is pressed into the grip portion 35 against a biasing force of the first coil springs 44.

Figure 10:
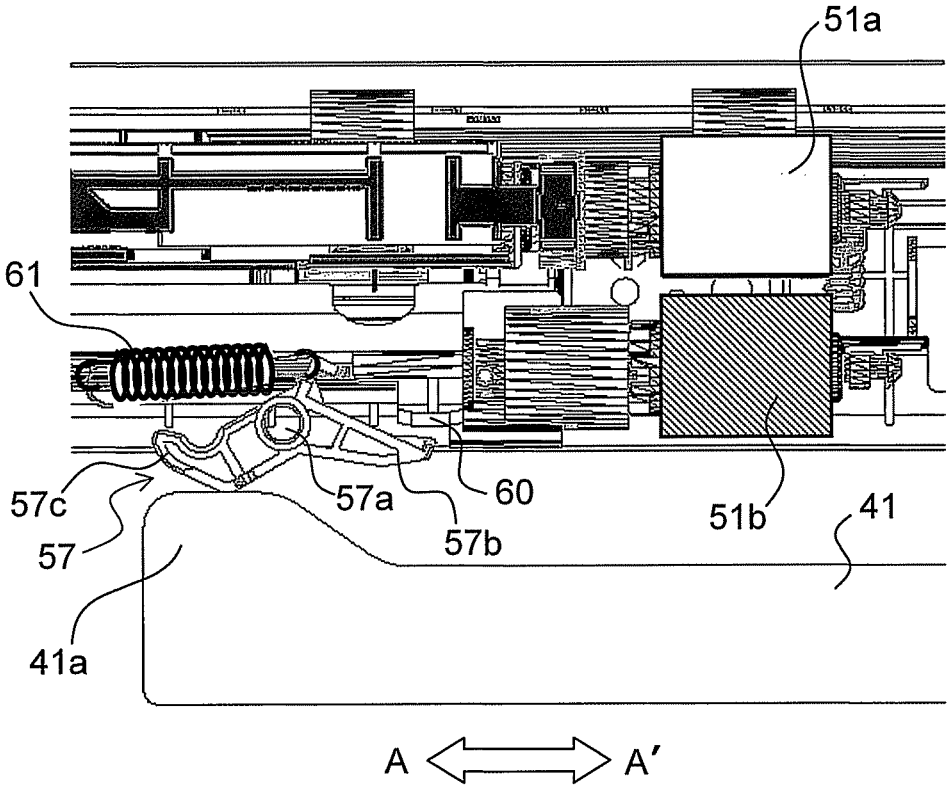
FIG. 10 is a partial enlarged view showing a state where a convex portion 41*a* formed at a lever pressure release member 41 pushes up a protruding portion 57*c* of the retard pressing lever 57.

Then, in conjunction with a movement of the operation lever 43 into the grip portion 35 (a movement thereof in an arrow direction in FIG. 9, which is the drawing-out direction of the paper feed cassette 10), as shown in FIG. 10, the lever pressure release member 41 linked to the operation lever 43 also slides in the drawing-out direction (an A' direction in FIG. 10), causing the convex portion 41*a* formed at the lever pressure release member 41 to push up the protruding portion 57*c* of the retard pressing lever 57. As a result, the retard pressing lever 57 turns in a clockwise direction against the biasing force of the second coil spring 61, causing the pressing portion 57*b*, which had been pushing up the retard roller 51*b*, to move downward, so that the retard holder 60 moves downward under its own weight. Thus, a pressure contact state between the retard roller 51*b* and the feed roller 51*a* is released. At this point in time, the protrusion 58*c* of the retard separation lever 58 is supported by the rib 10*a*.

When the paper feed cassette 10 in this state is drawn out in the drawing-out direction (arrow A' direction), before the convex portion 41*a* of the lever pressure release member 41 passes under the protruding portion 57*c* of the retard pressing lever 57, the retard separation lever 58 falls off from the rib 10*a* of the paper feed cassette 10. As a result, as shown in FIG. 11, the retard separation lever 58 swings in a clockwise direction under a biasing force of the torsion spring 59, so that the engagement portion 58*b* becomes engaged with an engagement piece 60*b* of the retard holder 60.

Figure 11:
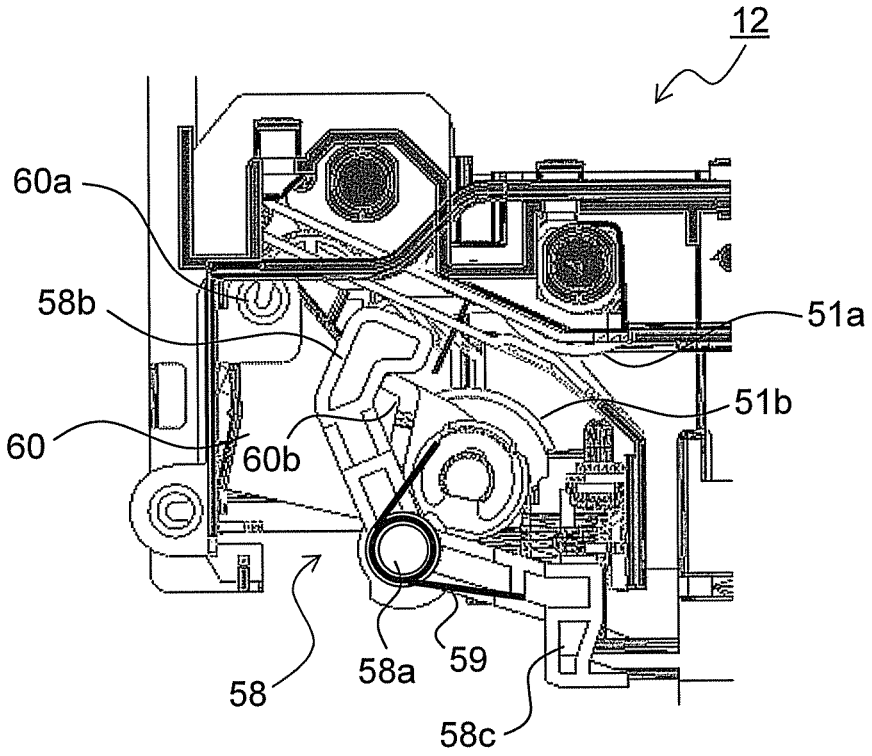
FIG. 11 is an enlarged view, as seen from the left direction in FIG. 5, showing a state where a separated state between a feed roller 51*a* and the retard roller 51*b* is maintained by the retard separation lever 58, in a state where the paper feed cassette 10 is drawn out from inside the main body of the image forming apparatus 100.

Herein, the biasing force of the second coil spring 61 biasing the retard pressing lever 57 in a counterclockwise direction in FIG. 10 is set to be smaller than the biasing force of the torsion spring 59 biasing the retard separation lever 58 in the clockwise direction in FIG. 11. Because of this, even after the convex portion 41*a* has passed under the protruding portion 57*c* of the retard pressing lever 57, the retard holder 60 is not pushed up to swing by the pressing portion 57*b* of the retard pressing lever 57, so that, in a state where the paper feed cassette 10 is completely drawn out, a separated state between the retard roller 51*b* and the feed roller 51*a* is maintained. This eliminates a possibility that, while the paper feed cassette 10 is being drawn out, the retard roller 51*b* and the feed roller 51*a* are again brought into pressure contact with each other, causing the paper sheet 18 to be nipped and thus to be flawed or torn.

In a case where the paper feed cassette 10 is inserted in the insertion direction (arrow A direction), when the paper feed cassette 10 has been inserted to a predetermined position, the retard separation lever 58 runs upon the rib 10*a* of the paper feed cassette 10. As a result, against the biasing force of the torsion spring 59, the retard separation lever 58 swings in the counterclockwise direction in FIG. 11, so that the engagement portion 58*b* and the retard holder 60 are disengaged from each other.

After that, the grip on the grip portion 35 is released, so that, under the biasing force of the first coil springs 44, the operation lever 43 protrudes from the grip portion 35, and in conjunction with the protruding of the operation lever 43, the lever pressure release member 41 slides from a state shown in FIG. 10 in an arrow A direction. This causes the retard pressing lever 57 to swing in the counterclockwise direction under the biasing force of the second coil spring 61, and thus the swing end of the retard holder 60 is pushed up by the pressing portion 57*a* of the retard pressing lever 57. As a result, the retard roller 51*b* is brought into pressure contact with the feed roller 51*a* at a predetermined pressure.

According to the configuration of this embodiment, in a state where the paper feed cassette 10 is mounted in the image forming apparatus 100, a pressure contact state between the rollers constituting the paper feed roller pair 51 can be released. This eliminates a possibility that the paper feed cassette 10 is drawn out in a state where the paper sheet 18 is nipped between the rollers constituting the paper feed roller pair 51, and thus in an operation of drawing out the paper feed cassette 10 from the image forming apparatus 100, the paper sheet 18 can be reliably prevented from being torn or flawed during a time when the paper feed cassette 10 is moved from the mounting position to reach the retard separation lever 58.

Furthermore, merely by gripping the grip portion 35 to press the operation lever 43 into the grip portion 35, a pressure contact state between the rollers constituting the paper feed roller pair 51 is released, and merely by releasing the grip from the grip portion 35, the rollers constituting the paper feed roller 51 are brought into pressure contact with each other. Accordingly, by performing an operation of gripping the grip portion 35 and an operation of releasing the grip from the grip portion 35, which are necessarily performed by a user, switching can be performed between a pressure contact state between the rollers constituting the paper feed rollers pair 51 and a state where the pressure contact between them is released. This eliminates the need for any particular operation for bringing the rollers constituting the paper feed roller pair 51 into pressure contact with each other or for releasing the pressure contact between them, and also eliminates a possibility that, at the time of drawing out the paper feed cassette 10, a pressure contact state between the rollers constituting the paper feed roller pair 51 is forgotten to be released, or after the paper feed cassette 10 has been inserted, the rollers constituting the paper feed roller pair 51 is forgotten to be brought back to the pressure contact state.

When the paper feed cassette 10 is at a position other than the mounting position, by an action of the retard separation lever 58, pressing by the retard roller 51*b* against the feed roller 51*a* is released, and thus it is sufficient that the lever pressure release member 41 operates when the paper feed cassette 10 is at the mounting position. That is, in order to smoothly perform an operation of drawing out the paper feed cassette 10 and an operation of inserting the paper feed cassette 10, it is desirable that, at both the time of drawing out the paper feed cassette 10 and the time of inserting the paper feed cassette 10, the paper feed cassette 10 pass through without the retard pressing lever 57 and the convex portion 41*a* coming into contact with each other.

By the way, in a state where the paper feed cassette 10 is mounted in the main body of the image forming apparatus 100, the rollers constituting the paper feed roller pair 51 are in a pressure contact state with each other. Because of this, there is a possibility that, when the image forming apparatus 100 is kept in storage for a long time in a state where the paper sheet cassette 10 is mounted in the main body thereof, a pressure contact state between the rollers constituting the paper feed roller pair 51 is kept for a long time, which leads to deformation of the feed roller 51*a* or the retard roller 51*b*.

Figure 12:
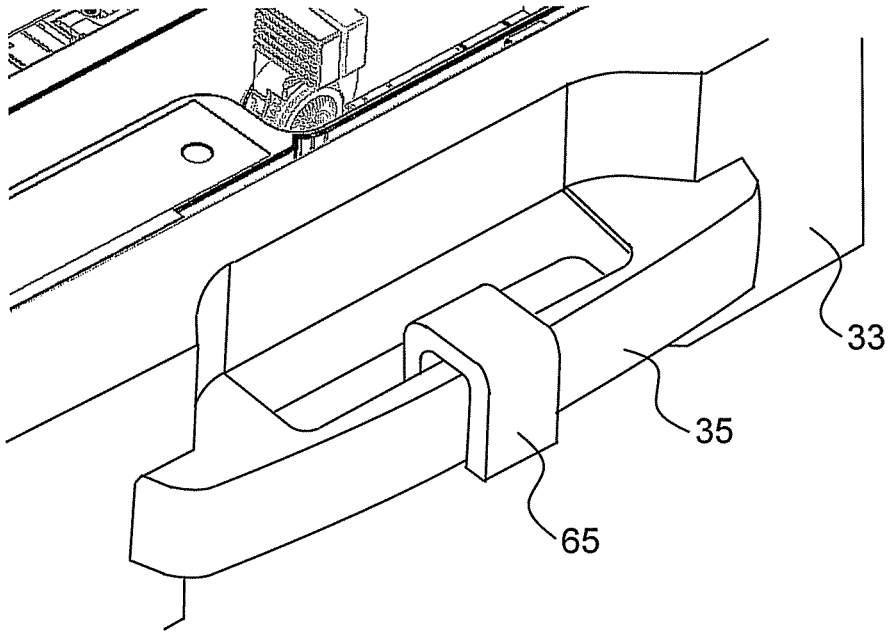
FIG. 12 is a partial perspective view of the grip portion 35 to which an operation lever fastening member 65 is attached.

As a solution thereto, as shown in FIG. 12, when the image forming apparatus 100 is kept in storage or transported, an operation lever fastening member 65 for holding, in a sandwiching manner, the grip portion 35 together with the operation lever 43 is attached. With this configuration, the operation lever 43 is always held in a state of being pressed into the grip portion 35, so that there is held a state where, as shown in FIG. 10, pressure contact between the retard roller 51*b* and the feed roller 51*a* is released. Thus, the feed roller 51*a* or the retard roller 51*b* can be prevented from being deformed when the image forming apparatus 100 is kept in storage or transported.

In addition to the above, without being limited to the foregoing embodiment, the present disclosure can be variously modified within the spirit of the present disclosure. For example, without being limited to the image forming apparatus 100 of a front loading type as described in the foregoing embodiment, the present disclosure is applicable quite similarly to an image forming apparatus of a type in which the paper feed cassette 10 is mounted so as to be insertable or drawable parallel to the paper feed direction.

Furthermore, without being limited to the monochrome multi-functional peripheral shown in FIG. 1, the present disclosure is applicable also to image forming apparatuses of other types having a drawable paper feed cassette, such as a color printer, a color multi-functional peripheral, a monochrome printer, a color multi-functional peripheral and a color printer each having an inkjet type image forming portion, and so on.

Moreover, without being limited to an image forming apparatus, the present disclosure is applicable also to, for example, an option feeder that is disconnectably connected to an image forming apparatus and feeds a paper sheet to the image forming apparatus.

The present disclosure can be utilized in a sheet feed device in which a recording medium housing cassette is drawably mounted. By utilizing the present disclosure, a sheet feed device that is capable of releasing a pressure contact state of a retard roller in a state where the recording medium housing cassette is mounted in a main body of an image forming apparatus can be provided by using a simple configuration.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A sheet feed device, comprising:

a feed unit that is provided in an apparatus main body; and a sheet loading cassette that is mounted so as to be insertable in or drawable from the apparatus main body, the feed unit includes:

a feed-out member that is brought into pressure contact with an upper surface of a sheet loaded in the sheet loading cassette and causes the sheet to move in a predetermined direction so that the sheet is fed out one after another;

a separation conveyance portion that is composed of a feed member that is disposed on a downstream side of the feed-out member in a sheet conveyance direction and a separation member that is disposed to be opposed to the feed member, and conveys a sheet fed out by the feed-out member one by one;

a separation holder that supports the separation member and is swingable in such a direction that the separation member comes into contact with or is separated from the feed member; and a pressing member that presses the separation holder in such a direction that the separation member comes into contact with the feed member, the sheet loading cassette includes:

a grip portion that is used to perform an operation of inserting or drawing out the sheet loading cassette;

a pressure release member that, in conjunction with the operation of drawing out the sheet loading cassette, comes into contact with the pressing member and thus releases the pressing member from the separation holder;

an operation lever that is protrudably and retractably provided at the grip portion; and a first biasing member that biases the operation lever in a protruding direction of the operation lever, wherein in conjunction with an operation in which the operation lever protrudes or retracts, the pressure release member is slidable with respect to the sheet loading cassette, and in a state where the sheet loading cassette is inserted in the apparatus main body, the operation lever is gripped together with the grip portion, and thus the pressure release member slides to come into contact with the pressing member, so that the pressing member is released from the separation holder.

2. The sheet feed device according to claim 1, further comprising:

a second biasing member, wherein the pressing member includes:

a first fulcrum that is rotatably supported to the feed unit, the pressing member being swingable around the first fulcrum;

a pressing portion that is contactable with the separation holder; and a protruding portion that protrudes from the first fulcrum in a direction different from a direction of the pressing portion and with which the pressure release member comes into contact, wherein the second biasing member biases the pressing portion in such a direction that the separation holder approaches the feed member.

3. The sheet feed device according to claim 2, wherein the pressure release member has a convex portion that is contactable with the protruding portion, and in a state where the sheet loading cassette is inserted in the apparatus main body, when the operation lever protrudes from the grip portion, the convex portion is positioned at a non-contact position on a downstream side in an insertion direction with respect to the protruding portion, and when the operation lever is retracted into the grip portion, the convex portion moves to an upstream side in the insertion direction by a distance corresponding to the operation lever sliding and is positioned at a contact position where it comes into contact with the protruding portion.

4. The sheet feed device according to claim 1, further comprising:

a separated state maintaining member that maintains the separation member in a pressing release state, wherein the sheet loading cassette is provided with a rib that switches the separation member between the pressing release state and a pressing state by coming into contact with or by being released from the separated state maintaining member, and when the sheet loading cassette is drawn out from a mounting position in the apparatus main body to a predetermined position, the separated state maintaining member is separated from the rib to be engaged with the separation holder and thus inhibits the pressing member from pressing the separation holder, and when the sheet loading cassette is inserted to the predetermined position, the separated state maintaining member comes into contact with the rib to be disengaged from the separation holder and thus allows the pressing member to press the separation holder.

5. The sheet feed device according to claim 4, wherein the separated state maintaining member includes:

a second fulcrum that is rotatably supported to the feed unit;

an engagement portion to be engaged with the separation holder;

a protrusion that protrudes from the second fulcrum to the opposite side of the engagement portion across the second fulcrum and with which the rib comes into contact; and a third biasing member that biases the engagement portion in such a direction that the separation holder is separated from the feed member.

6. The sheet feed device according to claim 4, wherein after the pressure release member comes into contact with the pressing member and thus the separation member is released from the feed member, before the pressure release member is separated from the pressing member as a result of an operation of drawing out the sheet loading cassette, the separated state maintaining member is separated from the rib.

7. The sheet feed device according to claim 1, further comprising:

an operation lever fastening member that holds, in a sandwiching manner, the grip portion together with the operation lever in a state where the operation lever is pressed into the grip portion.

8. An image forming apparatus comprising:

the sheet feed device according to claim 1.

* * * * *